US011300377B2

(12) United States Patent
Young et al.

(10) Patent No.: US 11,300,377 B2
(45) Date of Patent: Apr. 12, 2022

(54) TRIGGER ASSEMBLY FOR FIREARMS

(71) Applicants: Nicholas E. Young, Murray, UT (US); Cody Lee Rients, South Salt Lake, UT (US)

(72) Inventors: Nicholas E. Young, Murray, UT (US); Cody Lee Rients, South Salt Lake, UT (US)

( * ) Notice: Subject to any disclaimer, the term of this patent is extended or adjusted under 35 U.S.C. 154(b) by 0 days.

(21) Appl. No.: 17/023,491

(22) Filed: Sep. 17, 2020

(65) Prior Publication Data

US 2021/0080213 A1 Mar. 18, 2021

Related U.S. Application Data

(60) Provisional application No. 62/901,782, filed on Sep. 17, 2019.

(51) Int. Cl.

| | |
|---|---|
| ***F41A 19/12*** | (2006.01) |
| ***F41A 17/46*** | (2006.01) |
| ***F41A 19/10*** | (2006.01) |

(52) U.S. Cl.

CPC ..... *F41A 19/12* (2013.01); *F41A 17/46* (2013.01); *F41A 19/10* (2013.01)

(58) Field of Classification Search

CPC ..... F41A 19/12; F41A 19/10; F41A 19/15; F41A 17/46

See application file for complete search history.

(56) References Cited

U.S. PATENT DOCUMENTS

| | | | | |
|---|---|---|---|---|
| 3,020,662 | A * | 2/1962 | Merkel | F41A 3/18 42/11 |
| 5,355,768 | A * | 10/1994 | Felk | F41A 17/36 42/70.06 |
| 6,634,129 | B1 * | 10/2003 | Freeman, Jr. | F41A 3/26 42/69.02 |
| 7,337,574 | B2 * | 3/2008 | Crandall | F41A 19/43 42/75.03 |
| 8,944,041 | B2 * | 2/2015 | Hu | F41A 19/06 124/73 |
| 9,383,153 | B2 * | 7/2016 | Nebeker | F41A 17/56 |
| 9,689,635 | B2 * | 6/2017 | Krieger | F41A 17/64 |
| 10,378,847 | B2 * | 8/2019 | Folk | F41A 17/72 |
| 10,578,385 | B2 * | 3/2020 | Dextraze | F41A 19/16 |
| 10,684,087 | B2 * | 6/2020 | Thomele | F41A 19/32 |
| 10,809,030 | B2 * | 10/2020 | Geissele | F41A 17/46 |

* cited by examiner

*Primary Examiner* — Joshua T Semick

(57) ABSTRACT

A trigger assembly includes a trigger, a transfer bar having a distal end and a proximal end, the distal end of the transfer bar being coupled to the trigger and the proximal end having a step defined therein; and a sear configured to selectively engage the proximal end of the transfer bar.

10 Claims, 8 Drawing Sheets

TRIGGER ASSEMBLY FOR FIREARMS

CROSS REFERENCE TO RELATED APPLICATIONS

This application is the non-provisional application of U.S. Provisional Patent Application 62/901,782 filed Sep. 17, 2019 and entitled TRIGGER ASSEMBLY FOR FIREARMS, which is hereby incorporated by reference in its entirety.

BACKGROUND

Bullpup or other short-configuration rifles are designed to have a short, overall length compared to conventionally configured rifles, yet they maintain a relatively longer barrel. In such configurations, the actual trigger lever is coupled to the action by way of a transfer bar. Such a configuration may result in unresponsive triggers with a lot of creep/movement before the trigger breaks and fires the round. This may be due to the distance between the trigger and the firing mechanism (hammer or striker) and tolerance stack associated with the additional parts needed to connect the trigger to the firing mechanism.

SUMMARY

A trigger assembly includes a trigger, a transfer bar having a distal end and a proximal end, the distal end of the transfer bar being coupled to the trigger and the proximal end having a step defined therein; and a sear configured to selectively engage the proximal end of the transfer bar.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings, in which.

DETAILED DESCRIPTION OF SOME EXAMPLE EMBODIMENTS

As will be described in more detail hereinafter, trigger bar, trigger assemblies making use of such a trigger bar, and firearms making use of such trigger assemblies are provided that include a trigger bar configured to reduce creep of the trigger assembly during firing while offering a complete and repeatable reset of the trigger assembly after firing and providing a reliable safety assembly.

Figure 1:
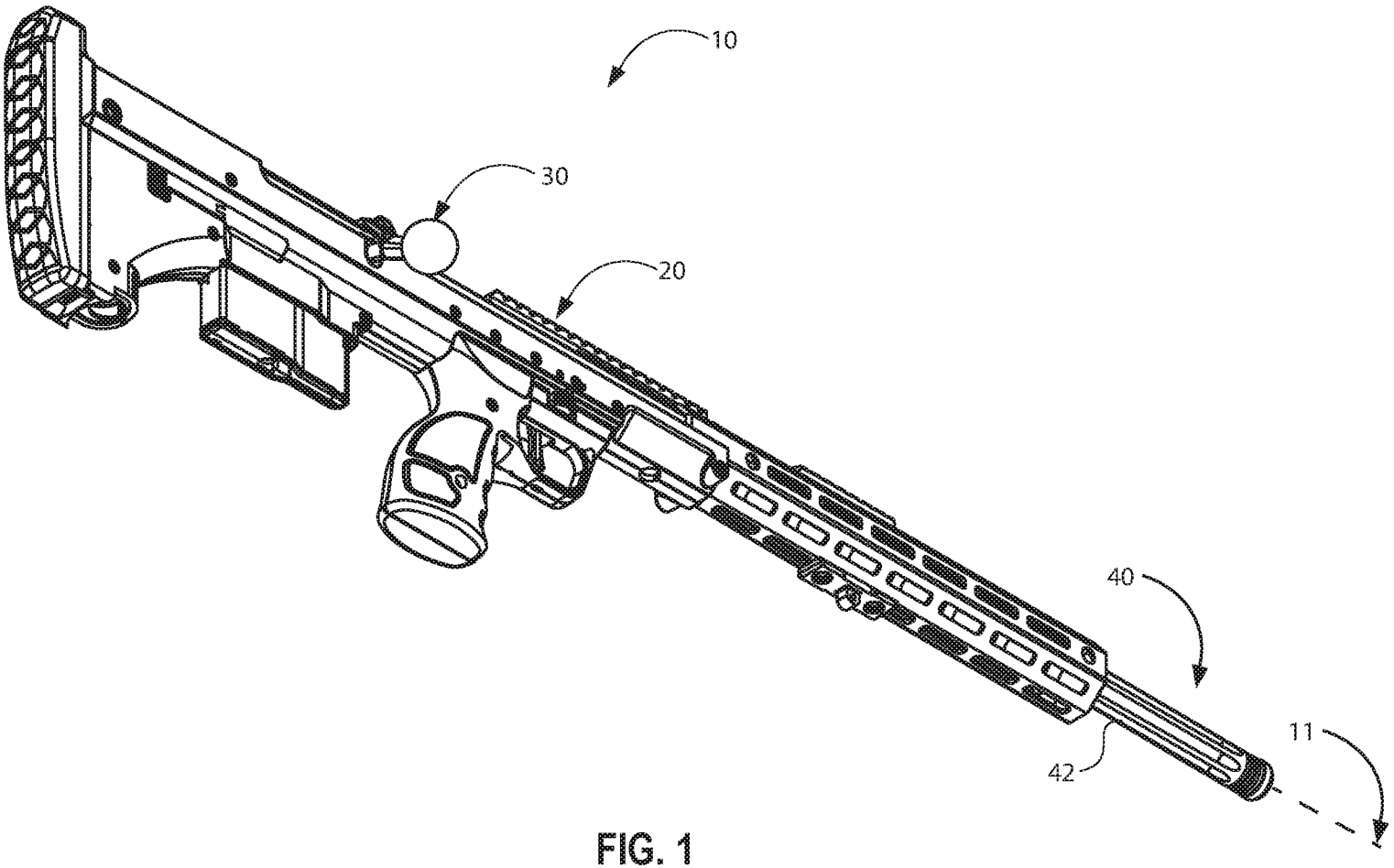
FIG. 1 illustrates a perspective view of an assembled firearm according to one example.

In particular, as shown in FIG. 1, a firearm 10 is provided that includes a receiver assembly 20 to which an exemplary action 30 is coupled. A barrel assembly 40 is further coupled to the receiver assembly 20. The barrel assembly 40 includes a barrel 42.

As used herein, distal will refer to positions that are relatively further away from an operator compared to more proximal, or closer components. In both instances, distal and proximal locations will be described with reference to a central axis 11; the central axis 11 extending through the center of the barrel 42 and through the receiver assembly 20. Transverse directions will be described as being at an angle to the central axis 11 or to an axis or axes that are offset from and parallel to the central axis. Axial translation will be described as being generally parallel to the central axis 11. Transverse motion will be described as being generally at an angle or normal to the central axis 11, particularly as described to rotation of various components of the action 30.

The firearms provided in this disclosure are configured as bullpup firearms (as will be described in more detail at an appropriate point hereinafter). In the illustrated example, the firearm 10 is configured as a bullpup rifle and as a bullpup, bolt-action rifle in particular. It will be appreciated that the firearm 10, according to the present example, may be configured as a bullpup firearm of any configuration, which includes semi-automatic and automatic rifles, though it will be appreciated that the firearm may have other bullpup configurations, which may include pistols, revolvers, and other types of firearms.

Figure 2A:
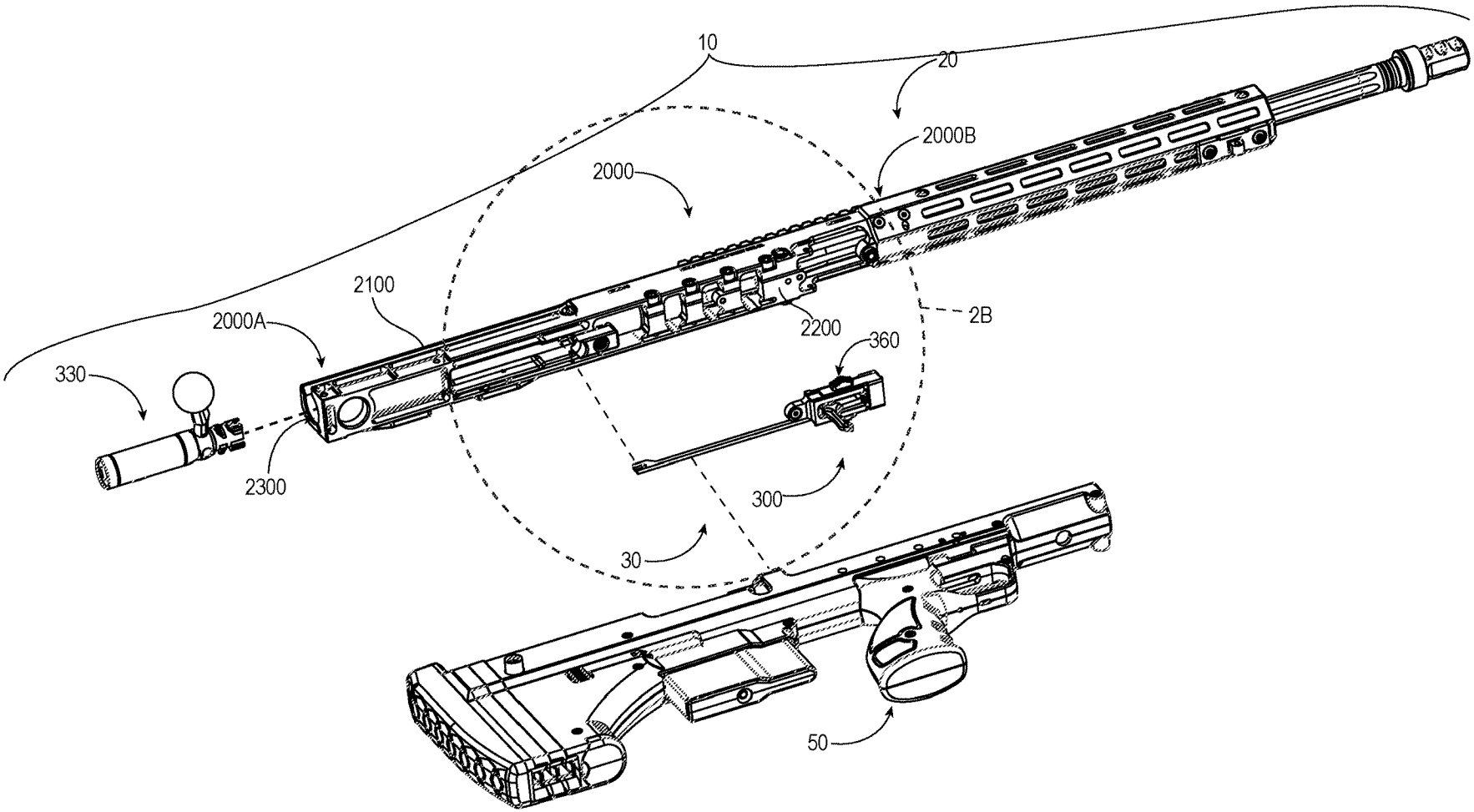
FIG. 2A illustrates an exploded view of the firearm of FIG. 1.

FIG. 2A is an exploded view of the firearm 10. In at least one example, the action 30 includes a trigger assembly 300 configured to interact with a bolt assembly 330 and a safety assembly 360. In particular, actuation of the trigger assembly 300 may act to discharge the bolt assembly 330 by moving the bolt assembly 330 between a charged state and a discharged state, as will be discussed in more detail hereinafter.

In at least one example, the firearm 10 further includes a stock assembly 50 coupled to the receiver assembly 20. It will be appreciated that the stock assembly 50 may be partially or completely integrated with the receiver assembly 20 in some examples.

As shown in FIG. 2A, the receiver assembly 20 includes receiver body 2000 with a proximal end 2000A and a distal end 2000B. The receiver body also includes a top portion 2100 and a bottom portion 2200. A bolt receiving recess 2300 is defined in the proximal end 2000A of the receiver body 2000. The bolt receiving recess 2300 is configured to receive the bolt assembly 330 therein to couple the bolt assembly 330 to the relevant portions of the firearm 10 as described herein.

Figure 2B:
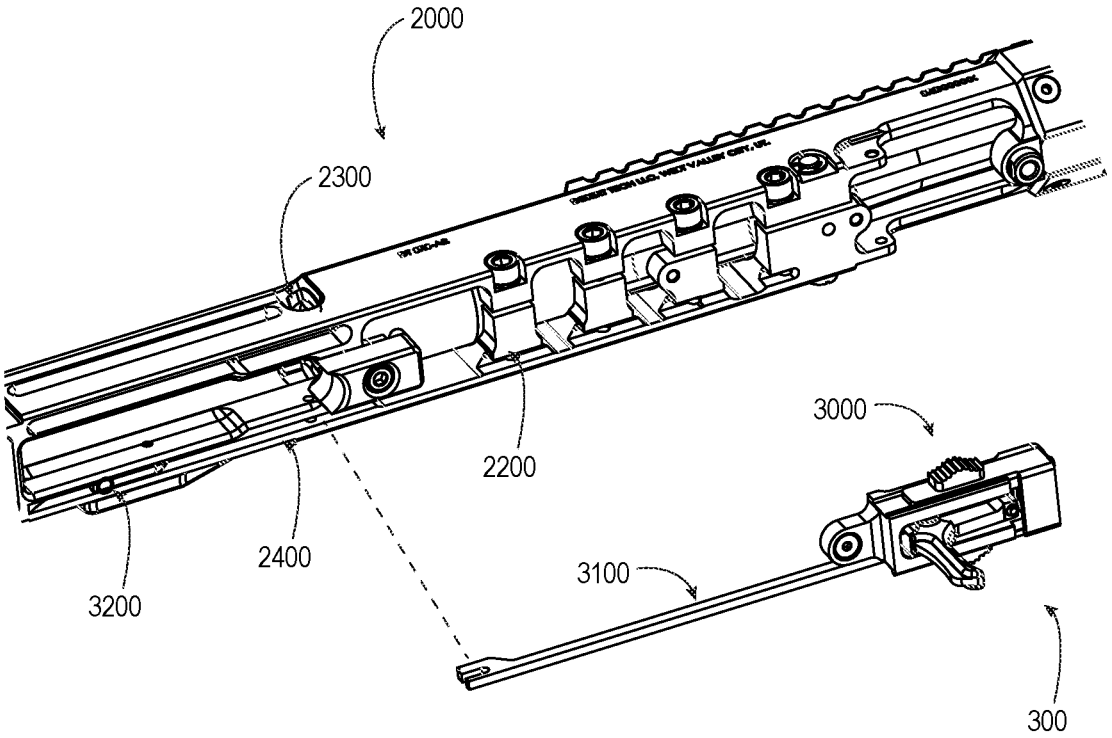
FIG. 2B illustrates a detail view of portion 2B of FIG. 2A.

FIG. 2B is a detailed view of portion 2B of FIG. 2A. As shown in FIG. 2B, a guide channel 2400 is defined in the bottom portion 2200 of the receiver body 2000. The trigger assembly 300 generally includes a trigger-lever assembly 3000, a transfer bar assembly 3100, and a sear 3200. As previously introduced, the exemplary firearm 10 is configured as a bullpup rifle. In such a configuration, the trigger-lever assembly 3000 is placed distally from the sear 3200 and is coupled to the trigger-lever assembly 3000 by the transfer bar assembly 3100. The trigger lever assembly 3000 is configured to be coupled to the receiver assembly 2000, such as by way of fasteners as is well known in the art.

The transfer bar assembly 3100 is configured to be received at least partially within the guide channel 2400. The sear 3200 is also configured to be at least partially received within the guide channel 2400 as shown. The guide channel 2400 is in communication with the bolt-receiving recess 2300 such that when the sear 3200 is in place relative to the receiver body 2000, the sear 3200 is positioned to cooperate with the bolt assembly 330 (FIG. 2A).

Figure 2C:
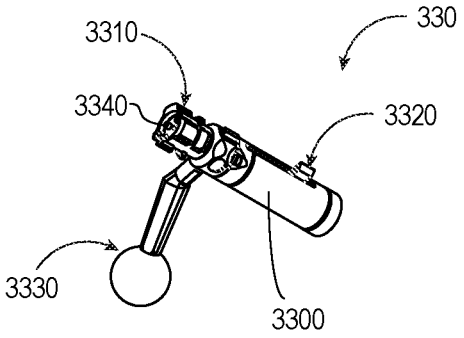
FIG. 2C illustrated a perspective view of a bolt assembly.

Referring now to FIG. 2C, the bolt assembly 330 generally includes a bolt body 3300, a bolt head 3310, a striker 3320, and a bolt handle 3330. When the action 30 (FIG. 2A) is coupled to the receiver assembly 20 (FIG. 2A), the sear 3200 (FIG. 2B) is positioned to selectively engage the striker 3320 to set and release the trigger assembly 300 (FIG. 2B), as will be described in more detail at an appropriate point hereinafter.

As seen in FIG. 2C, the bolt assembly 330 generally includes a bolt body 3300, a bolt head 3310, a striker 3320, and a bolt handle 3330. The bolt body 3300 houses a bolt spring (not shown), the striker 3320, and a firing pin 3340 as generally known in the art. In the cocked position, the bolt spring (not shown) exerts a biasing force against the striker 3320, which is countered and held in check by the trigger assembly 300 (FIG. 2B) and the interaction of the striker 3320 with the sear 3200 (FIG. 2B) in particular.

When the trigger assembly 300 (FIG. 2B) is actuated, the striker 3320 is released and the force exerted against the striker 3320 by the bolt spring (not shown) causes the striker 3320 to impact the firing pin 3340, which in turn extends from the bolt head 3310. If a cartridge is placed, the firing pin 3340 hits a primer and ignites a powder charge, as is known in the art. The actuation and reset of the trigger assembly will now be discussed in more detail.

Figure 3A:
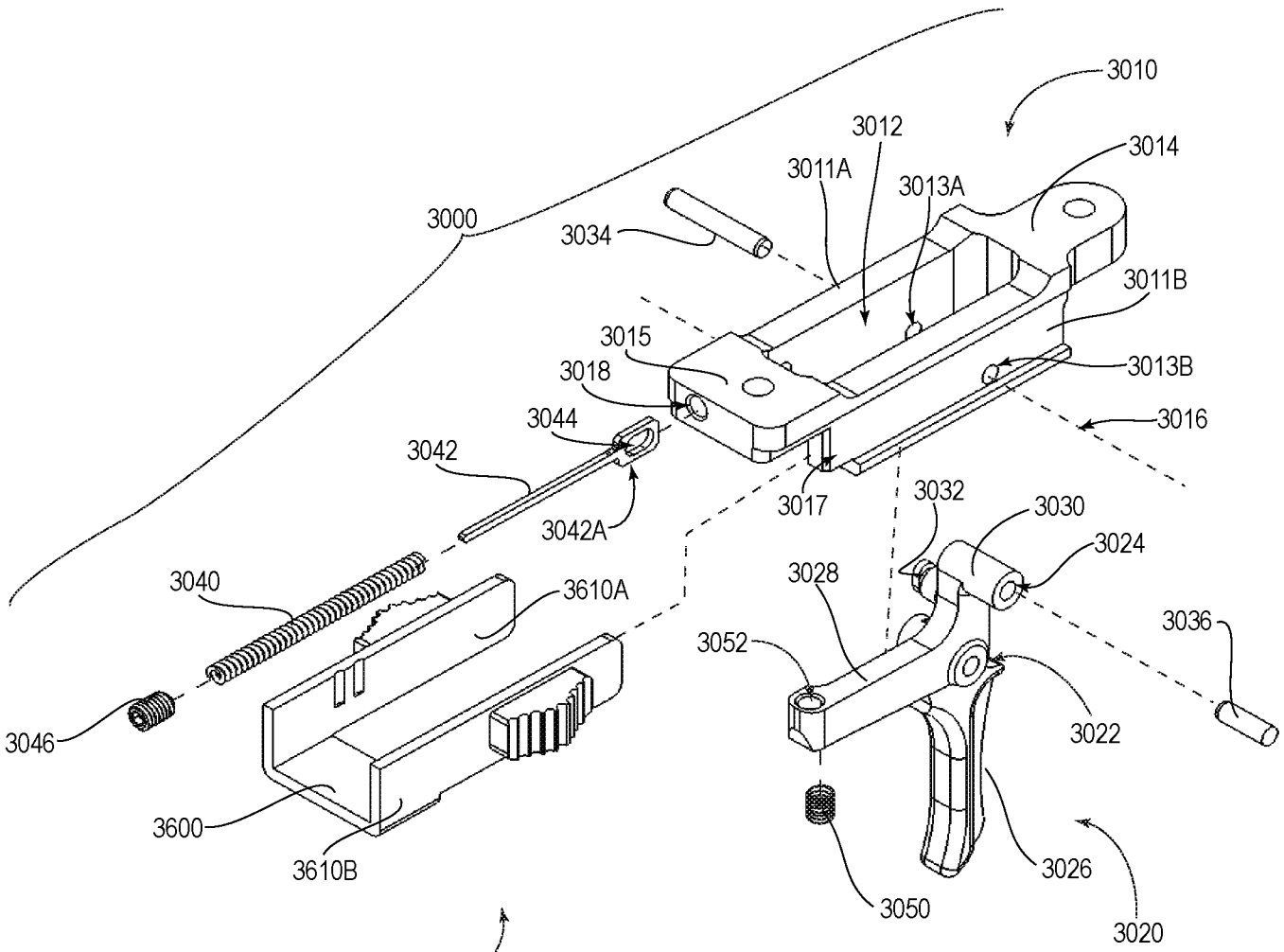
FIG. 3A illustrates an exploded view of a trigger lever assembly according to one example.

In particular, trigger lever assembly 3000 is configured to cooperate with the transfer bar assembly 3100 to move the sear 3200 to provide the set and release of the trigger assembly 300. FIG. 3A shows the trigger lever assembly 3000 in more detail.

As shown in FIG. 3A, the trigger lever assembly 3000 generally includes a trigger housing 3010 and a trigger 3020. The trigger housing 3010 includes opposing sidewalls 3011A, 3011B that define a trigger-receiving recess 3012 therebetween. Axle-receiving recesses 3013A, 3013B are defined in the opposing sidewalls 3011A, 3011B. The trigger housing 3010 also includes a proximal tab 3014 and distal tab 3015. A trigger axis 3016 is defined through the center of the opposing axle-receiving recesses 3013A, 3013B.

In the illustrated example, the trigger 3020 generally includes a trigger hub 3022 having a trigger-axle recess 3024 defined therein. A trigger lever 3026 extends away from the trigger hub 3022. A safety engagement portion 3028 of the trigger 3020 also extends away from the trigger hub 3022 in the same general plane as the trigger lever 3026, but in a direction that is offset at some angular separation from the trigger lever 3026.

A transfer bar engagement portion 3030 also extends away from the trigger hub portion. In the illustrated example, the transfer bar engagement portion 3030 extends in an opposite direction away from the trigger hub 3022 similarly to the trigger lever 3026. A trigger weight adjustment connector 3032 is associated with the trigger 3020. In at least one example, the trigger weight adjustment connector 3032 is positioned between the transfer bar engagement portion 3030 and the trigger hub 3022. Further, the trigger 3020 may be formed as a single piece such that rotation of the trigger lever 3026 about the trigger hub 3022 results in corresponding angular rotation of both the safety engagement portion 3028 and the transfer bar engagement portion 3030.

In the illustrated example, the trigger 3020 is coupled to the trigger housing 3010 by inserting the trigger 3020 into position within the trigger housing 3010 such that the axle-receiving recesses 3013A, 3013B in the trigger housing 3010 are aligned with the axle-receiving recess 3024 in the trigger 3020.

A trigger axle 3034 is then positioned through the axle-receiving recesses 3013B, 3013A, thereby rotatingly coupling the trigger 3020 to the trigger housing 3010 to allow the trigger 3020 to rotate about the trigger axis 3016. The trigger axis 3016 is transverse or even normal to an axis that is offset from and parallel to the central axis 11 (best seen in FIG. 1).

In the illustrated example, a biasing member, such as a trigger spring 3040, is positioned between the transfer bar engagement portion 3030 of the trigger 3020 and the distal tab 3015. In the illustrated example, the trigger spring 3040 is configured as a compression spring that is configured to exert a force between the transfer bar engaging portion 3030 of the trigger 3020 and the trigger housing 3010 that acts to move the transfer bar engagement portion 3030 away from the distal tab 3015 of the trigger housing 3010.

Since the trigger 3020 is pivoting or rotationally coupled to the trigger housing 3010, pushing the transfer bar engagement portion 3030 away from the distal tab 3015 results in rotation of the trigger 3020. In the illustrated example, the rotation is anticlockwise such that rotation of the transfer bar engagement portion 3030 in a generally rearward direction results in the trigger lever 3026 moving generally forward due to the same rotation. Such a movement acts to reset the trigger lever assembly 3000 and therefore the trigger assembly 300 (FIG. 2A) after a firing action. Such a movement also acts to help ensure that movement of the trigger 3020 is transferred to the rest of the trigger assembly 300 (FIG. 2A), which movement is described in more detail hereinafter.

In at least one example, a set screw recess 3018 is defined in the distal tab 3015. The trigger spring 3040 may be coupled to a spring rod guide 3042 which in turn may be coupled to the trigger 3020, and the transfer bar engagement portion 3030 of the trigger 3020 in particular. As shown in the figures, a proximal end 3042A of the spring rod guide 3040 may have a guide slot 3044 defined therein that allows the spring rod guide 3042 to couple to the transfer bar engagement portion 3030 of the trigger 3020, such as with a pin 3036.

A trigger weight adjustment screw 3046 may be secured to the trigger housing 3010 via the set screw recess 3018. In at least one example, the trigger spring 3040 may abut the trigger weight adjustment screw 3046 when the trigger assembly 3020 is assembled. Further, the trigger spring 3040 may be partially constrained within the set screw recess 3018 to thereby abut the trigger weight adjustment screw 3046. In such an example, rotation of the trigger weight adjustment screw 3046 results in axial movement of the trigger weight adjustment screw 3046, which acts to compress the trigger spring 3040 (in the case of proximal axial movement of the trigger weight adjustment screw 3046) or allow the trigger spring 3040 to expand (in the case of distal axial movement of the trigger weight adjustment screw 3046) to thereby increase or decrease the biasing force exerted against the transfer bar engagement portion 3030 respectively.

A force exerted against the trigger lever 3026 to overcome the biasing force may be referred to as the pull weight of the trigger assembly. Accordingly, adjusting the biasing force allows for the adjustment of the pull weight. Movement of the trigger lever 3026 actuates the rest of the trigger and subsequently allows for reset, as will now be discussed in more detail.

As shown in the FIG. 3A, the safety assembly 360 generally includes a trigger blocking portion 3600 and opposing lateral guides 3610A, B extending away from the trigger blocking portion 3600. The opposing lateral guides 3610A, 3610B are configured to engage safety guide channels 3017 defined in the trigger housing 3010.

The trigger blocking portion 3600 is configured to move between a safe position which engages the trigger 3020, and the safety engagement portion 3028 of the trigger 3020 in particular, and a fire position in which the trigger 3020 is allowed to rotate. As will be discussed in a more appropriate point hereinafter, a safety engagement adjustment mechanism 3050 associated with the safety engagement portion 3028 may be adjusted to help ensure the trigger blocking portion 3600 engages the trigger 3020 to prevent or minimize rotation of the trigger 3020 to thereby prevent unintended discharge of the action 30 (FIG. 1) while the safety assembly 360 is engaged.

In the illustrated example, the safety engagement adjustment mechanism 3050 is configured to adjustably extend away from the safety engagement portion 3028. In the illustrated example, the safety engagement adjustment mechanism 3050 is configured as a set screw that may be adjusted to reduce or eliminate a gap between the safety engagement adjustment mechanism 3050 and the trigger blocking portion 3600 of the safety assembly 360 when the trigger blocking portion 3600 is in position relative to the trigger 3020. In at least one example, the adjustment mechanism 3050 is adjustable in a direction that is parallel to the trigger lever 3026 and thus transverse to the trigger axis 3016. In at least one example, the safety engagement adjustment mechanism 3050 is coupled to a similarly shaped recess 3052 defined in the safety engagement portion 3028. For example, the recess 3052 may be threaded to allow rotation of the safety engagement adjustment mechanism 3050 to cause it to extend away from the safety engagement portion 3028 the desired amount.

Figure 3B:
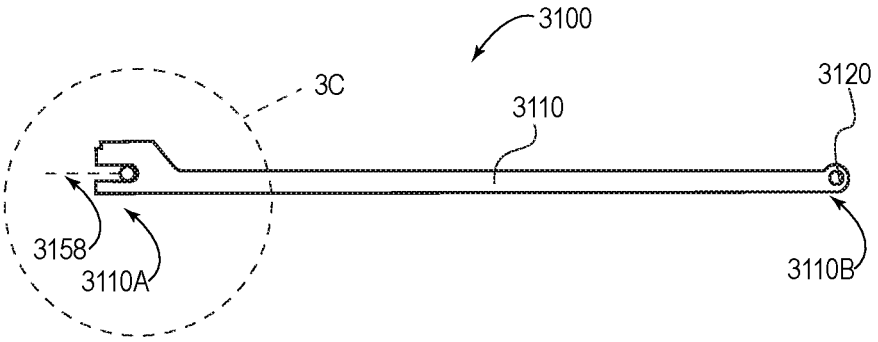
FIG. 3B illustrates a transfer bar assembly according to one example.

The transfer bar engagement portion 3030 is coupled to the transfer bar assembly 3100 as shown in FIG. 2B. FIG. 3B shows the transfer bar assembly 3100 in more detail. As shown in FIG. 3B, the transfer bar assembly 3100 includes a transfer bar body 3110 having a proximal end 3110A and a distal end 3110B.

In at least one example, the transfer bar engagement portion 3030 (FIG. 3A) of the trigger 3020 (FIG. 3A) is rotatingly or pivotingly coupled to a distal end 3110B of the transfer bar body 3110 via a distal guide pin 3120. The distal guide pin 3120 is coupled to the receiver body 2100 (FIG. 2B) and extends across or through the guide channel 2400 (best seen in FIG. 2B) to engage and guide the transfer bar body 3110 to allow axial translation of the transfer bar body 3110.

Figure 3C:
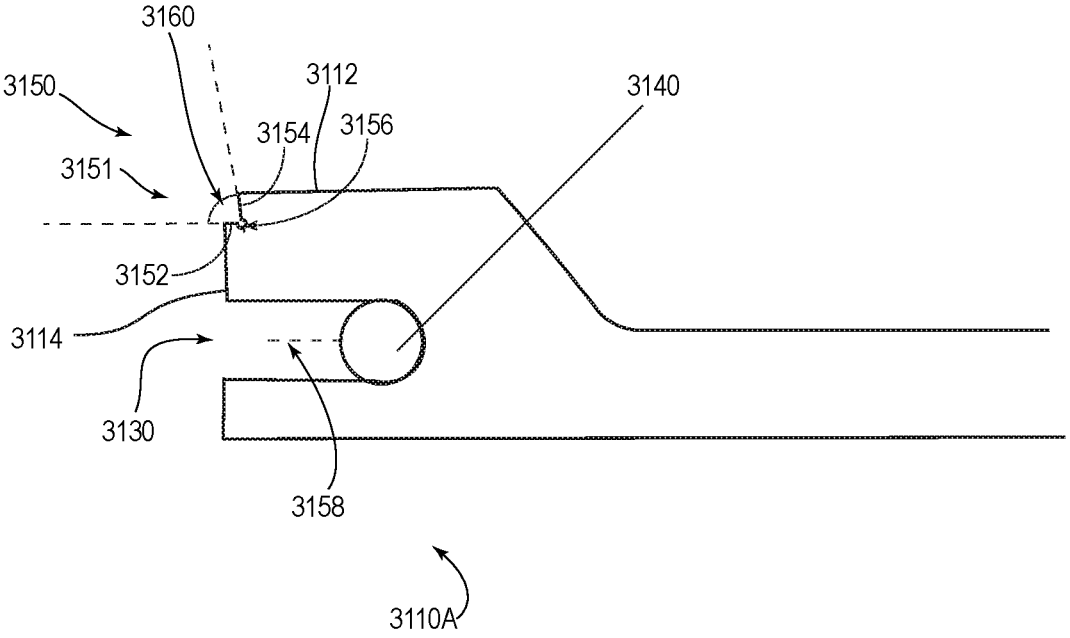
FIG. 3C is a detailed view of the portion 3C of FIG. 3B.

As shown in FIG. 3C, the proximal end 3110A of the transfer bar body 3110 (FIG. 3B) includes a guide channel 3130 defined therein configured to receive a proximal guide pin 3140 therein. The proximal guide pin 3140 is also coupled to the receiver body 2100 (FIG. 2A) and extends across or through the guide channel 2150 (best seen in FIG. 2) to engage and guide the transfer bar body 3110 (FIG. 3B) to allow axial translation of the transfer bar body 3110 (FIG. 3B).

The proximal guide pin 3140 interacts with the proximal end 3110A of the transfer bar 3110 (FIG. 3B) to cause movement of the proximal end 3110A to be constrained to axial movement or movement parallel to the central axis 11 (FIG. 1) described above.

FIG. 3C is a detail view of portion 3C of FIG. 3B. As shown in FIG. 3C, the proximal end 3110A of the transfer bar body 3110 also includes a sear engaging portion 3150. As shown in FIG. 3C, the sear engaging portion 3150 has a primary upper surface 3112 and a primary proximal end surface 3114. A step 3151 is defined in the proximal end 3110A by a sear-supporting surface 3152, a sear-abutting surface 3154, and a notch 3156 between the sear-supporting surface 3152 and the sear-abutting surface 3154. Such a configuration constrains the potential engagement between the sear 3200 and the transfer bar body 3110 to the sear-supporting surface 3152 rather than the entire primary upper surface 3112 of the sear engaging portion 3150.

The notch 3156 may be concave in that the notch defines a gap that extends beyond the projected intersection between the sear-supporting surface 3152 and the sear abutting surface 3154. The notch 3156 removes some portion of the material associated with the sear-supporting surface 3152, which may act to reduce the friction between the sear 3200 and the sear-supporting surface 3152 when the sear 3200 moves axially relative to the sear-supporting surface 3152. The transfer bar body 3110 defines a transfer bar axis 3158 that is generally parallel to the central axis 11 (FIG. 1) when the firearm 10 (also FIG. 1) is assembled.

The sear-abutting surface 3154 may be described as a first face portion that is transverse to the transfer bar axis 3158. The sear-supporting surface 3152 may be described as a second face. A notch angle 3160 is formed between the sear-supporting surface 3152 and the sear-abutting surface 3154. In at least one example, the notch angle 3160 is less than or equal to 90 degrees. The notch angle 3160 may also be described as acute. In at least one example, the sear-supporting surface 3152 may be generally parallel to the transfer bar axis 3158.

Figure 4A:
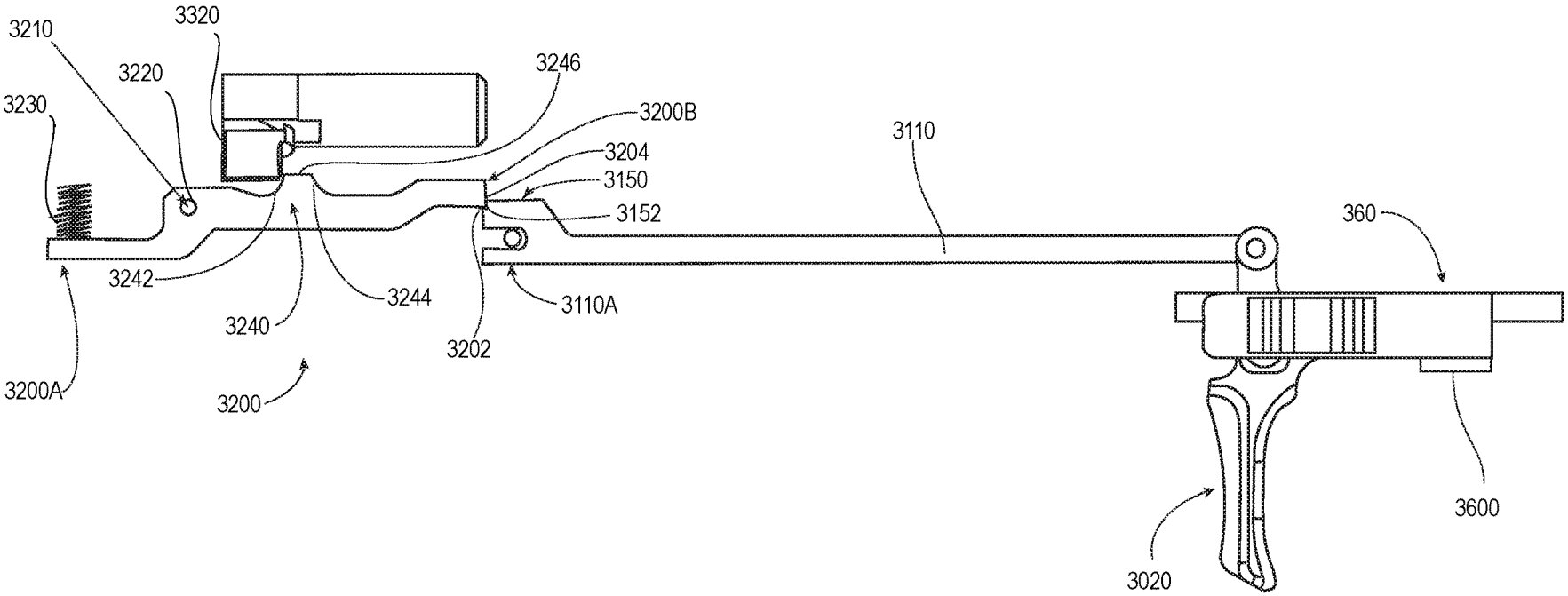
FIG. 4A illustrates a partial view of selected components of an action in a charged, safe state.
Figure 4B:
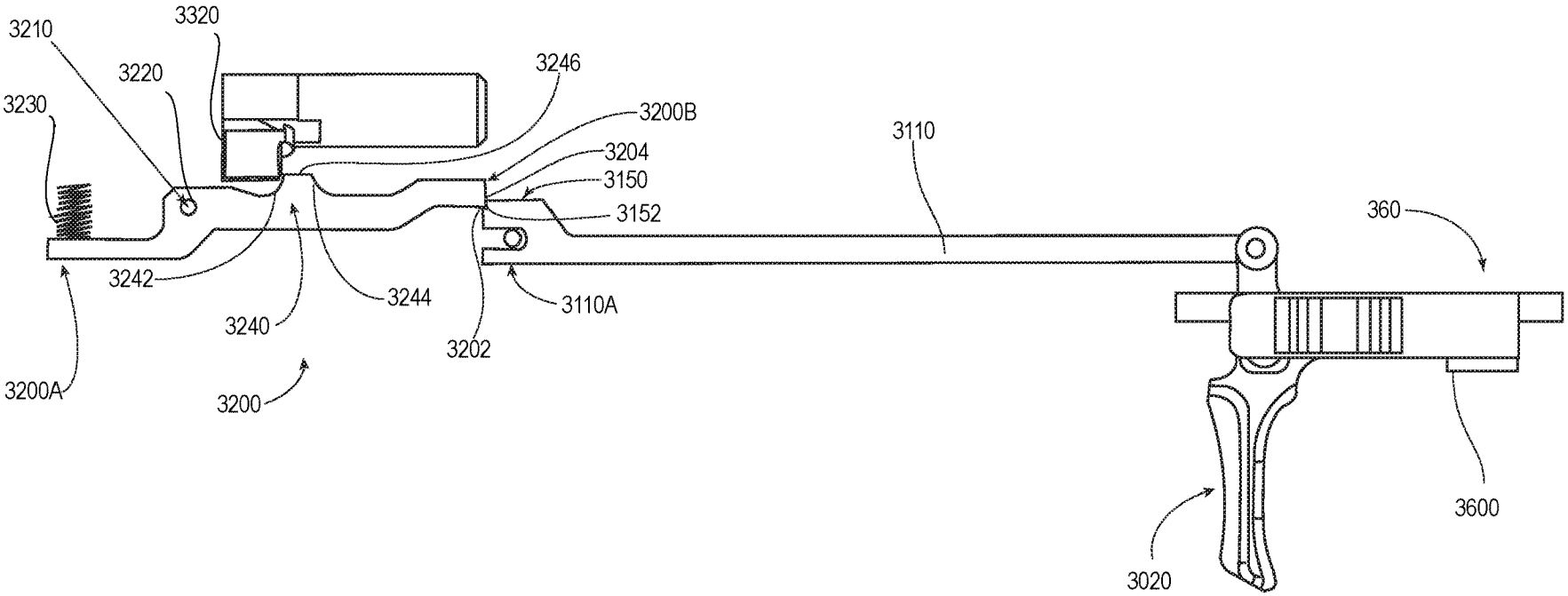
FIG. 4B illustrates a partial view of selected components of an action in a charged, fire state.
Figure 4C:
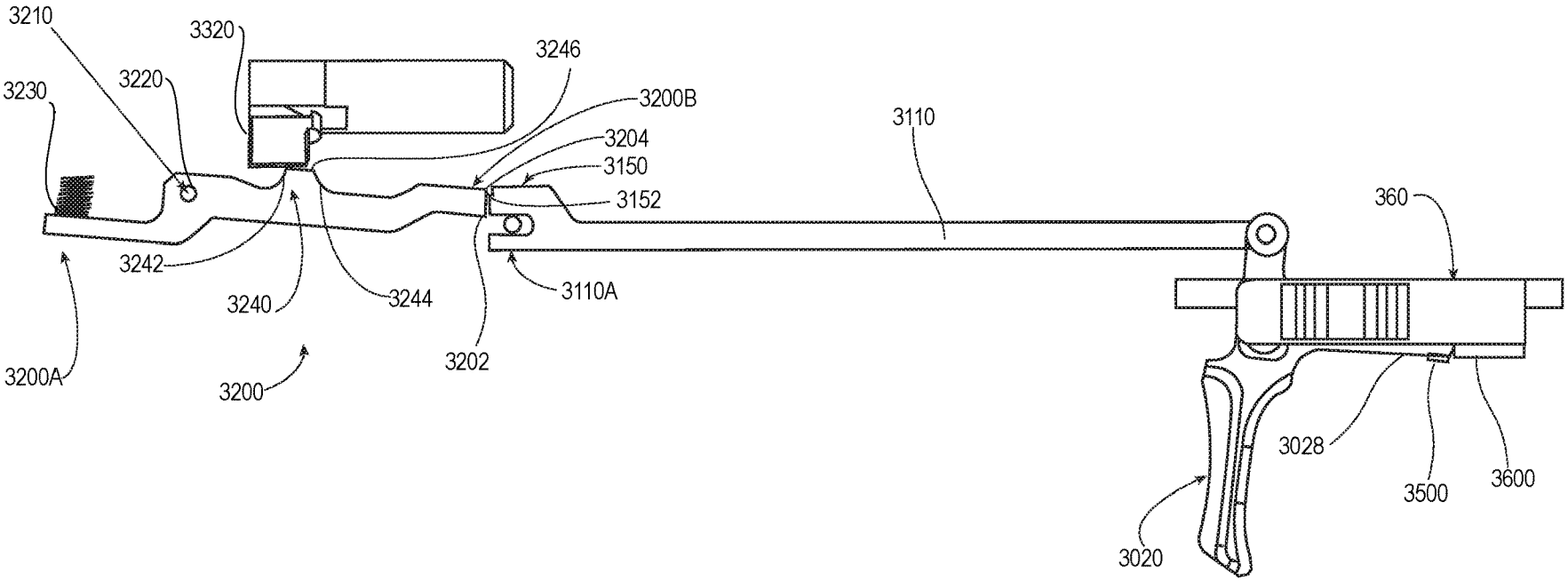
FIG. 4C illustrates a partial view of selected components of an action in a discharged state.

As shown in FIG. 4A, the sear-supporting surface 3152 (best seen in isolation in FIG. 3C) is configured to engage the sear 3200. In at least one example, the sear 3200 includes a proximal end 3200A and a distal end 3200B. The sear 3200 is configured to pivot or rotate about a sear axis 3210 by way of a sear pin 3220. The sear axis 3210 is normal or perpendicular to the transfer bar axis 3158 (FIG. 3C). As shown in FIGS. 4A-4C, a biasing member such as a sear spring 3230 acts against the proximal end 3200A of the sear 3200 to rotate the sear in such a manner as to rotate the distal end 3200B of the sear 3200 away from the sear-supporting surface 3152. Such a configuration allows the trigger 3020 to reset after the trigger 3020 has been pressed to release the bolt assembly 330 (FIG. 3C).

As shown in FIG. 4A, in the absence of actuation or pull on the trigger 3020, the trigger 3020 will rotate toward a reset position due to the force exerted on the trigger 3020 by the trigger spring 3040 (FIG. 3A) as previously introduced.

As the bolt assembly 330 (FIG. 2C) is cocked, the striker 3320 is moved into position relative to the sear 3200. The cocking or charging motion of the bolt assembly 330 (FIG. 2C) will be described at an appropriate point hereinafter. As shown in FIGS. 4A-4C and in FIG. 4A in particular, the sear 3200 includes a striker engagement portion 3240 between the sear axis 3210 and the distal end 3200B. The striker engagement portion 3240 includes a proximal ramp portion 3242, a distal ramp portion 3244, and a flat portion 3246. Such a configuration allows the striker 3320 to engage the proximal ramp portion 3242 of the striker engagement portion 3240 while the bolt assembly 330 (FIG. 2C) is in the charged state.

While thus positioned, the bolt spring (not shown) acts against the striker 3320 to urge the striker 3320 into contact against the striker engagement portion 3240 and against the proximal ramp portion 3242 thereof in particular. The sear 3200 is configured such that the proximal ramp portion 3242 is offset from the sear axis 3210. As a result, the axial and other forces acting on the sear 3200 via the striker 3320 act to urge the sear 3200 to pivot about the sear axis 3210. In the illustrated example, this rotation is in an anticlockwise direction.

Such rotation moves the distal end 3200B of the sear 3200 into engagement with the sear engaging portion 3150 of the transfer bar body 3110 and into engagement with the sear-supporting surface 3152 and (and other similar faces or engagement portions described above). In particular, the distal end 3200B of the sear 3200 includes a transfer bar engagement surface 3202 and a transfer bar abutment surface 3204. Accordingly, engagement between the sear 3200 and the transfer bar body 3110 occurs between the transfer bar engagement surface 3202 and the sear-supporting surface 3152 as well as between the transfer bar abutment surface 3204 and the sear-abutting face 3154.

Movement of the sear 3200 out of engagement with the transfer bar body 3110 would result in release of the striker 3320 and actuation of the action 30, as described elsewhere herein. Accordingly, the engagement between the proximal end 3110A of the transfer bar body 3110 and the sear 3200 prevents the striker 3320 from being released and maintains the action 30 in a cocked or ready-to-fire position.

The creep or movement the sear 3200 travels before it is released from the transfer bar body 3110 is constrained by the width of the sear-supporting surface 3152. In particular, as previously introduced, movement of the trigger 3020 results in axial movement of the transfer bar body 3110. Axial distal movement (and distal movement of the transfer bar body 3110 in particular) of the transfer bar body 3110 that is greater than the overlap or engagement between transfer bar engagement surface 3202 and the sear-supporting surface 3152 results in the sear 3200 falling from engagement with the transfer bar body 3110, which acts to cause the distal end 3200B of the sear 3200 to drop, as shown in FIG. 4C. In particular, the safety engagement portion 3028 and the adjustment mechanism 3500 clear the trigger blocking portion 3600 of the safety assembly 360.

As the distal end 3200B of the sear 3200 drops, the proximal ramp 3242 of the striker engagement portion 3240 of the sear 3200 moves out of engagement with the striker 3320 allowing the bolt spring (not shown) to drive the striker forward, thereby discharging the bolt assembly 360.

Limiting the amount of creep may result in a crisp-feeling trigger, especially if disengagement occurs efficiently as the sear 3200 falls out of engagement with the transfer bar assembly 3100 as the trigger 3020 is pressed. Rotation of the trigger lever 3026 without corresponding movement of the transfer bar body 3110 may be referred to as play, which may result from tolerance stack among the various components of the trigger assembly 300. It is often desirable to remove undesired play from the action to provide a crisp trigger pull. However, it is also desirable for the safety assembly 360 to reliably block rotation of the trigger 3020 while simultaneously reducing play.

As previously discussed, the safety assembly 360 may be deployed to selectively prevent (or allow) rotation of the trigger 3020 to thereby prevent or allow actuation or pressing of the trigger 3020, which in turn acts to prevent or allow the firearm 10 (FIG. 1) from discharging depending on the position of the safety assembly 360. In either case, the engagement between the striker 3320 and sear 3200 may be described as a charged or cocked position for the action 30 (FIG. 1). In the charged position, the trigger lever 3026 will be at a charged, reset, ready, or initial axial position.

While the trigger 3020 is in the charged position, the adjustment mechanism 3050 (FIG. 3A), which is configured as a set screw in the illustrated example) may provide sufficient engagement between the trigger 3020 (and the safety engagement adjustment portion 3028 thereof in particular) and the safety assembly 360 (and the trigger blocking portion 3600 in particular) to reduce, limit, or even prevent rotation of the trigger 3020 when the safety assembly 360 is in position relative to the trigger 3020 as shown in FIG. 4A.

In particular, the adjustment mechanism 3050 (FIG. 3A) may be adjusted toward or away from the safety engagement portion 3028 of the trigger 3020. In at least one example, the adjustment mechanism 3050 (FIG. 3A) may be adjusted to allow the trigger blocking portion 3600 to just clear the adjustment mechanism when the safety assembly 360 moves axially parallel to the central axis 11 (FIG. 1) as the safety assembly 360 is moved from the safe position shown in FIG. 4A to the fire position shown in FIG. 4B.

Such a configuration allows for minimal play in the trigger assembly 300 (FIG. 2B) while still allowing a technician to set proper engagement between the safety assembly 360 and the trigger assembly 300 (FIG. 2B) to ensure proper operation of the safety assembly 360. Reducing or eliminating rotation of the trigger 3020 while the safety assembly 360 is deployed can help prevent unintended discharge while also reducing creep associated with the trigger assembly as used in firearms having a bullpup configuration.

As shown in FIG. 4C, and as previously described, pressing the trigger lever 3026 (while the trigger blocking portion 3600 of the safety assembly 360 is positioned so as to allow rotation of the trigger) causes the trigger 3020 to rotate about the trigger axle 3034, which in turn results in axial, distal movement of the transfer bar body 3110, which acts to move the proximal end 3110A of the transfer bar body 3110 away from the distal end 3200B of the sear 3200, resulting in discharge of the action 30 as described above.

Thereafter, the bolt assembly 330 may be reset to draw the striker 3320 proximally or rearwardly using the bolt handle 3330 (FIG. 3) as is known in the art. As the striker is drawn rearwardly as part of an extraction movement for the bolt assembly 330 (FIG. 3), the striker 3320 is withdrawn past the striker engagement portion 3240 of the sear 3200, which allows the sear spring 3230 to rotate the sear 3200 about the sear axis 3210 to cause the distal end 3210B of the sear 3200 to rotate to a position in which the distal end 3210B of the sear 3200 is in position relative to the proximal end 3110A of the transfer bar body 3110 as shown in FIG. 4A.

Referring simultaneously to FIG. 2A and FIG. 4C, as the bolt assembly 360 moves forward or distally as part of a charging movement, the striker 3320 engages the now raised striker engagement portion 3240 and the proximal ramp 3242 in particular and stops forward movement of the striker 3320. The rest of the bolt assembly 330 (FIG. 2C), however, continues forward as part of the charging step causing the bolt spring (not shown) to be compressed between the striker 3320 and the bolt body 3300 to thereby charge the assembly. The resulting compression causes the striker 3320 to exert the forces on the sear 3320 described above, which causes the sear 3320 to engage the transfer bar body 3110 as described above.

What is claimed is:

1. A trigger assembly having, a trigger having a trigger hub, a trigger lever extending away from the trigger hub, a safety engagement portion extending away from the trigger hub, and a transfer bar engagement portion also extending away from the trigger hub, wherein the trigger is configured to rotate about the trigger hub;

a transfer bar having a distal end and a proximal end, the distal end of the transfer bar being coupled to the trigger and the proximal end having a step defined therein; and a sear configured to selectively engage the proximal end of the transfer bar, the step defined in the proximal end of the transfer bar is formed from a sear-supporting surface and a sear-abutting surface, the transfer bar defines a transfer bar axis, the sear-abutting surface is transverse to the transfer bar axis, and wherein the trigger is configured to rotate about the trigger hub and wherein rotation of the trigger about the trigger hub results in translation of the transfer bar parallel to the transfer bar axis.

2. The trigger of claim 1, wherein the transfer bar engagement portion is coupled to the distal end of the transfer bar, and wherein the safety engagement portion further includes an adjustment mechanism extending therefrom.

3. A firearm action, comprising:

a trigger assembly having, a trigger having a trigger hub, a trigger lever extending away from the trigger hub, a safety engagement portion extending away from the trigger hub, and a transfer bar engagement portion also extending away from the trigger hub, wherein the trigger is configured to rotate about the trigger hub, a transfer bar defining a transfer bar axis, the transfer bar having a distal end and a proximal end, the distal end of the transfer bar being coupled to the trigger and the proximal end having a sear-abutting surface and a sear-supporting surface defining a step in the proximal end of the transfer bar, a sear; and a bolt assembly, the bolt assembly configured to move between a charged state and a discharged state, wherein the sear engages the bolt assembly and the sear-supporting surface on the proximal end of the transfer bar to maintain the bolt assembly in the charged state and wherein rotation of the trigger about the trigger hub results in translation of the transfer bar parallel to the transfer bar axis to move the sear-supporting surface out of engagement with the sear to allow the bolt to move from the charged state to the discharged state.

4. The firearm action of claim 3, wherein the sear-supporting surface is disposed at an angle to the sear-abutting surface, wherein the angle is less than or equal to 90 degrees.

5. The firearm action of claim 3, wherein the sear is configured to rotate about a sear axis, the sear axis being normal to the transfer bar axis.

6. The firearm action of claim 3, further comprising a safety assembly, wherein the transfer bar engagement portion is coupled to the distal end of the transfer bar, and wherein the safety engagement portion further includes an adjustment mechanism extending therefrom configured to vary the distance between the safety engagement portion and the safety assembly.

7. A firearm, comprising:

a receiver defining a central axis, a firearm action coupled to the receiver, the firearm action including a trigger assembly having, a trigger, a transfer bar, the transfer bar having a distal end and a proximal end, the distal end of the transfer bar being coupled to the trigger and the proximal end having a sear-abutting surface and a sear-supporting surface defining a step in the proximal end of the transfer bar, and a sear, wherein the trigger includes a trigger hub, a trigger lever extending away from the trigger hub, a safety engagement portion extending away from the trigger hub, and a transfer bar engagement portion also extending away from the trigger hub, wherein the trigger is configured to rotate about the trigger hub; and a bolt assembly, the bolt assembly configured to move between a charged state and a discharged state, wherein the sear engages the bolt assembly and the sear-supporting surface on the proximal end of the transfer bar to maintain the bolt assembly in the charged state and wherein rotation of the trigger about the trigger hub results in translation of the transfer bar parallel to the central axis to move the sear-supporting surface out of engagement with the sear to allow the bolt to move from the charged state to the discharged state.

8. The firearm of claim 7, wherein the sear-supporting surface is disposed at an angle to the sear-abutting surface, wherein the angle is less than or equal to 90 degrees.

9. The firearm of claim 7, wherein the sear is configured to rotate about a sear axis, the sear axis being normal to the central axis.

10. The firearm of claim 7, further comprising a safety assembly, wherein the transfer bar engagement portion is coupled to the distal end of the transfer bar, and wherein the safety engagement portion further includes an adjustment mechanism extending therefrom configured to vary the distance between the safety engagement portion and the safety assembly.

* * * * *